US005801479A

United States Patent [19]

Shinoda

[11] Patent Number: 5,801,479

[45] Date of Patent: Sep. 1, 1998

[54] COLOR CATHODE-RAY TUBE AND METHOD OF MANUFACTURING THE SAME

[75] Inventor: Masaki Shinoda, Aichi, Japan

[73] Assignee: Sony Corporation, Japan

[21] Appl. No.: 681,333

[22] Filed: Jul. 23, 1996

[30] Foreign Application Priority Data

Jul. 26, 1995 [JP] Japan ..... 7-190725

[51] Int. Cl.[6] ..... H01J 29/06

[52] U.S. Cl. ..... 313/402; 313/407; 445/30; 445/37

[58] Field of Search ..... 313/402, 407, 313/403; 445/30, 37

[56] References Cited

U.S. PATENT DOCUMENTS

| | | | |
|---|---|---|---|
| 4,495,437 | 1/1985 | Kume et al. | 313/407 X |
| 5,382,871 | 1/1995 | Funahashi et al. | 313/407 X |
| 5,406,168 | 4/1995 | Takagi | 313/407 X |
| 5,416,380 | 5/1995 | Horiuchi | 313/407 |
| 5,550,428 | 8/1996 | Kume et al. | 313/407 |

FOREIGN PATENT DOCUMENTS

| | | |
|---|---|---|
| 0 121 628 A1 | 11/1983 | European Pat. Off. . |
| 0 393 488 A2 | 4/1990 | European Pat. Off. . |

*Primary Examiner*—Ashok Patel

*Attorney, Agent, or Firm*—Ronald P. Kananen

[57] ABSTRACT

A cathode-ray tube consuppress deterioration and reduce unevenness in color of a picture by preventing an electrode element thereof from being twisted. The color cathode-ray tube includes a frame and an aperture grill stretched across and fixed on the frame and having an electrode element. The aperture grill is stretched across and fixed on the frame in a state that the frame is applied with a compressive force and the aperture grill is applied with a tension. In a process of stretching and fixing the aperture grill across and on the frame, of the tension applied to the aperture grill, a maximum tension applied to the electrode element is set within the range from 30% to 85% of a tensile strength of the electrode element.

11 Claims, 5 Drawing Sheets

COLOR CATHODE-RAY TUBE AND METHOD OF MANUFACTURING THE SAME

BACKGROUND OF THE INVENTION

1. Field of the Invention:

The present invention relates to an improvement of an aperture grill stretched across a frame and particularly to a color cathode-ray tube, hereinafter referred to as a color CRT, which prevents the aperture grill from being twisted.

2. Description of the Related Art

A color CRT having a one-gun three-beam structure, a stripe fluorescent plane and an aperture grill, hereinafter referred to as AG, has hitherto been well known. The AG used in such color CRT is arranged such that a stripe grill is formed of a thin soft steel plate by a chemical etching method and fixed by welding or the like on a frame formed of a steel frame with a predetermined tension being applied to the frame.

FIGS. 1 and 2 are perspective views respectively showing the frame of the above color CRT and the AG thereof fixed on the frame. In FIG. 1, a frame 1 has upper and lower members, hereinafter referred to as A members, 2A and 2B which are formed of upper and lower steel products having L-shaped cross sections and which are manufactured by such methods as pressing or die pulling. Each of left and right members, hereinafter referred to B members 3L and 3R thereof is manufactured by bending a steel square bar of steel products so that the steel square bar should be lateral-U-shaped and further bending both bending ends thereof inward and perpendicularly. The ends of bent portions thereof are welded to rear sides of the A members 2A and 2B to form the frame 1.

An AG 4 is made by forming stripe grills or apertures 5 through a rectangular thin soft steel plate by photographic chemical etching method as shown in FIG. 2. The AG 4 has a thickness of about 0.1 mm. The number of grills 5 thereof is selected within the range from 300 to 1200 lines, and a pitch between the respective aperture grills 5 is selected substantially within the range from 0.5 to 0.8 mm. Electrode elements 7 are formed between grills 5, 5.

When the AG 4 is welded to such frame 1 as shown in FIG. 2, the A members 2A, 2B are surface-finished and welding portions 6 of the AG are welded thereto. The AG 4 is applied with tension in the upper and lower direction shown by an arrow A—A in FIG. 2. Further, the frame 1 is applied with a compressive force in the upper and lower direction shown by an arrow B—B in FIG. 1, thereby both of them being welded to each other.

The AG 4 welded to the frame 1 is cut away with the grills 5 and the electrode elements 7 being left. As shown in FIG. 3, spring holders 8 are welded to the A and B members 2B, 3L and 3R. A leaf spring 9 having an engagement aperture to be engaged with a pin provided on a side surface of a face panel (not shown) is welded to each of the spring holders 8. Thus, a color selection electrode 10 is formed.

After the AG 4 is completely welded to the frame 1, the color selection electrode 10 used in the color CRT is subjected to a heat treatment for removing a treatment strain in a process previously carried out before the spring holder 8 and the spring 9 are welded to the frame 1.

This heat treatment is generally called a black treatment, wherein steel product surfaces of the frame 1 and the AG 4 are uniformly covered with black $Fe_3O_4$, triiron tetraoxide, passed through a hot-gas furnace as shown in FIG. 4, and heated to about 460° C. for preventing generation of $Fe_2O_3$ diiron trioxide, brown rust. Thereby, reflection of light resulting from emission of a fluorescent plane on an AG surface may be prevented.

Such heat treatment causes a dimensional change of the color selection electrode 10, particularly the electrode element 7. This will be described in detail. When the color selection electrode 10 in which the spring 9 and the spring holder 8 are not welded to the frame 1 is passed through the hot-gas furnace shown in FIG. 4, the color selection electrode 10 brought from a furnace inlet 11 is gradually increased in temperature in accordance with a temperature increase inclination 13 and its temperature reaches a maximum temperature of 460° C. When the color selection electrode 10 is cooled thereafter, a temperature decrease inclination 14 of the frame 1, having a large heat capacity, and a temperature decrease inclination of the AG 4, having a small heat capacity, particularly that of the electrode element 7 thereof, are different from each other. Since the electrode element 7 having the small heat capacity is rapidly cooled and the frame 1 is gradually cooled, a tension corresponding to a temperature difference therebetween is applied to the electrode element 7 in addition to a tension previously applied thereto, which elongates the electrode element 7. If the elongation thereof at this time exceeds a plasticity limit of the steel product of the electrode element 7 of the AG 4, then the electrode element 7 cannot be returned to its original length, and is kept in its elongated state, which encourages the twist of the electrode element 7.

Subsequently, after the color selection electrode 10 heated to 460° is cooled in accordance with a temperature decrese inclination 14 and ejected from a furnace outlet 12 of the hot-gas furnace, the electrode is exposed to the air at room temperature. Therefore, since the electrode element 7 shrinks rapidly cooled and the frame 1 is gradually cooled because of difference between the heat capacities of the frame 1 and the electrode element 7 of the AG 4, the electrode element 7 shrinks first, which leads to the twist thereof.

As described above, there is then a problem that since the twist of the electrode element 7 of the AG 4 changes a width of the grill 5 and the consequent non-uniform width of the grill 5 masks a color fluorescent stripe to be coated on an inner surface of the face panel, non-uniform fluorescent stripe is formed, which deteriorates a resolution of the color CRT and causes a color unevenness on a picture.

SUMMARY OF THE INVENTION

The present invention is made to provide a color cathode-ray tube which solves the above problems, and its object is to obtain a color cathode-ray tube which can suppress deterioration of the resolution and reduce a color unevenness by preventing the electrode element from being twisted after the black treatment of the color selection electrode and a method of manufacturing such color cathode-ray tube.

In order to solve the above problem, according to the present invention, when an aperture grill is stretched at a frame, tension of an electrode element is set within the range from 30% to 85% of a tensile strength thereof at a position where the electrode element of an aperture grill is applied with maximum tension.

According to such arrangement, it is possible to obtain a color cathode-ray tube which can suppress deterioration of the resolution and reduce a color unevenness by preventing the electrode element from being twisted entirely.

DESCRIPTION OF THE PREFERRED EMBODIMENT

Figure 1:
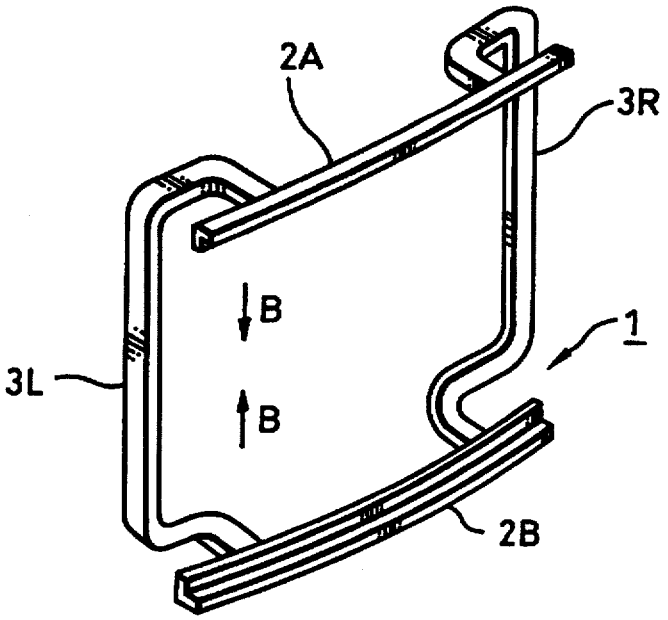
FIG. 1 PRIOR ART
FIG. 1 is a perspective view showing a frame of a conventional color selection electrode.
Figure 2:
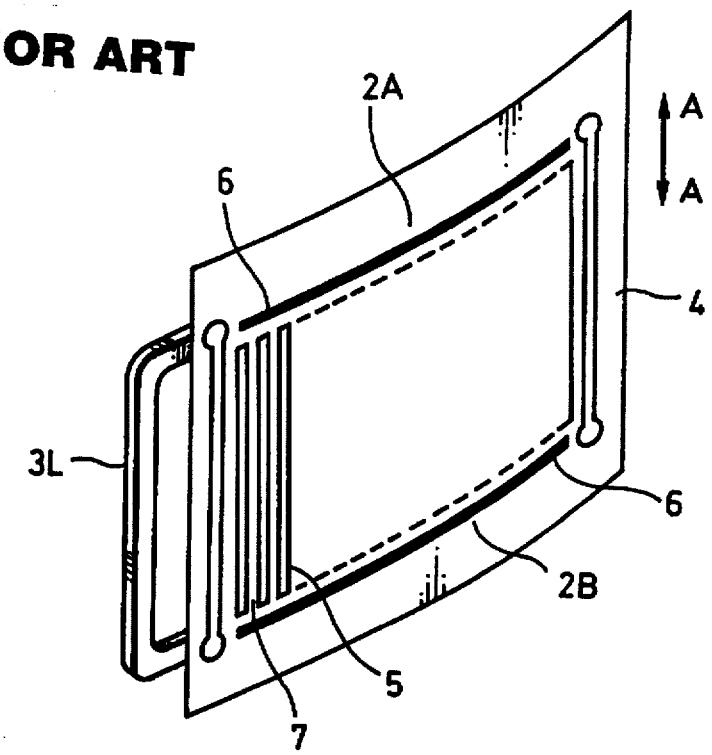
FIG. 2 PRIOR ART
FIG. 2 is a perspective view showing an assembled state of the frame and the aperture grill of the color selection electrode.
Figure 3:
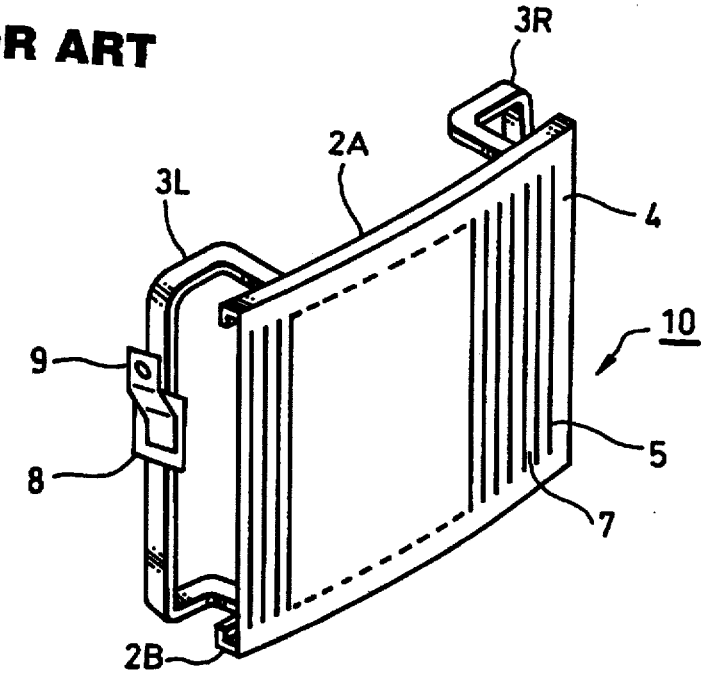
FIG. 3 PRIOR ART
FIG. 3 is a perspective view showing the color selection electrode.
Figure 4:
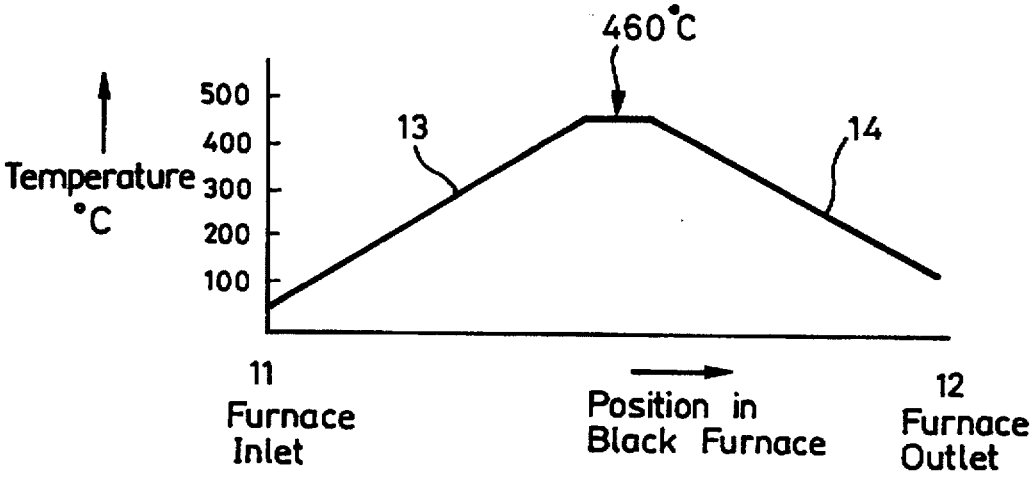
FIG. 4 PRIOR ART
FIG. 4 is a graph used to explain a black processing carried out after the assembly of the color selection electrode.

A color selection electrode according to the present invention will hereinafter be described with reference to FIGS. 5A, 5B and 6. A frame 1 having a shape shown in FIG. 5A or 5B described with reference to FIG. 1 is widely applied to a frame of the color selection electrode. A color selection electrode 10 shown in FIG. 5B is arranged by welding an AG 4 to a frame 1 in which U-shaped B members 3L, 3R are welded to both side ends between upper and lower A members 2A, 2B.

Figure 5A:
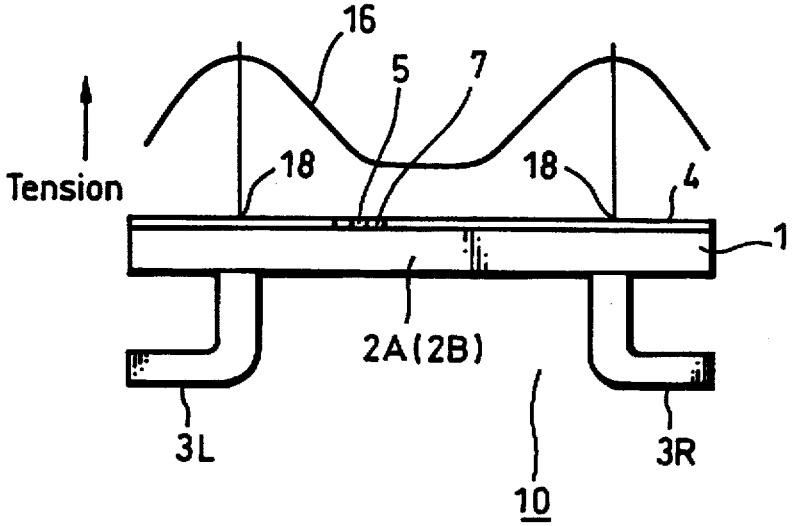
FIGS. 5A and 5B are explanatory diagrams each showing a stress distribution of a color selection electrode used in a color cathode-ray tube according to the present invention.
Figure 5B:
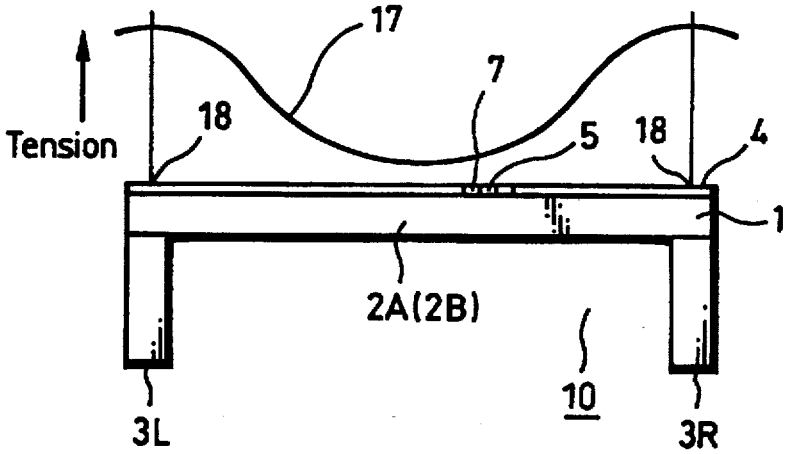

As shown by curves 16, 17 in FIGS. 5A, 5B, respective stress distributions of the above color selection electrodes of two kinds show that the tensions are maximum at positions 18 where the B members 3L, 3R are welded to the A members 2A, 2B.

Figure 6:
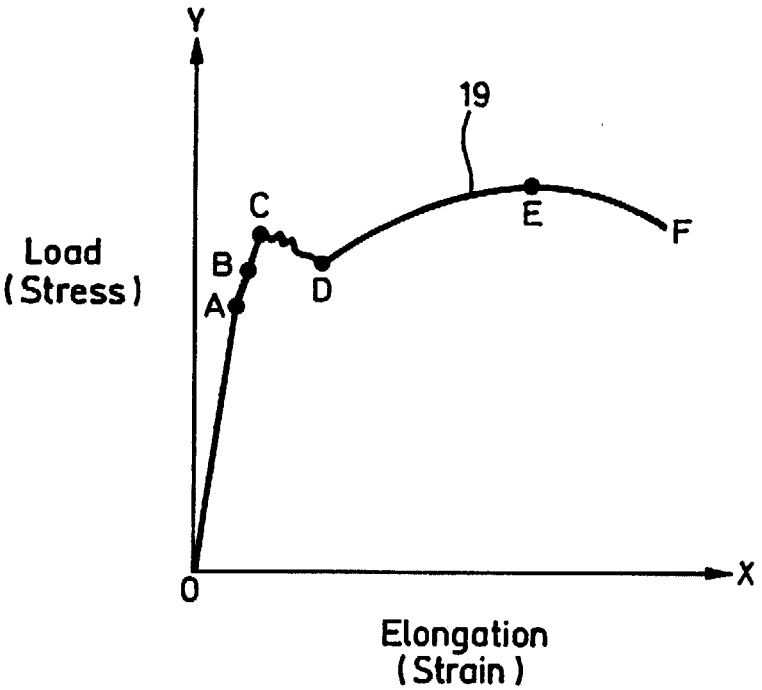
FIG. 6 is a load deformation graph used to explain a stress change of an aperture grill of the color selection electrode of the color cathode-ray tube according to the present invention.

FIG. 6 is a load deformation graph showing a relationship between a stress and a strain. An ordinate thereof indicates a load obtained when the electrode element 7 of the AG 4 generally formed of a soft steel or similar material is loaded on a tension tester and pulled while the load is being increased. An abscissa thereof indicates an elongation of the electrode element 7 resulting therefrom. The relationship therebetween is recorded as shown by a curve 19 of FIG. 6.

The load deformation graph of FIG. 6 may be considered as a nominal stress-strain graph in which the ordinate indicates a stress as a value obtained by dividing the load by an original cross-section area of a test piece and the elongation of the test piece is indicated as a strain represented by a value obtained by dividing the elongation by an original length of the test piece.

A point A in the curve 19 of the nominal stress-strain graph is a limit of proportional increase of the load and the elongation. A point B therein is a limit of elasticity which allows the test piece to be elongated by application of the load and, after removal of the load, to be stopped in elongation and returned to its original state. At an upper yield point of a point C, slip is started in the less-resistance direction inside the test piece and the test piece is elongated without the applied load and reached to a point D which is a lower yield point. At a point E, the applied load becomes maximum. At a point F, the test piece is cut.

Specifically, since the electrode element 7 elongated so as to be brought in its plasticity region exceeding the elasticity limit of the point B cannot be restored to its original length, a plurality of electrode elements 7 of the AG 4 are twisted at their random positions when they are cooled.

In this embodiment, a tensile strength of a value of stress obtained by dividing a load $P_{max}$ (kg) at the maximum load point E of the above curve 19 by an original cross-section area $A_O$ ($MM^2$) of the electrode element 7 which is the test piece, is defined as a tensile strength δB. Specifically, the tensile strength δB is expressed by;

$$\delta B = \frac{P_{max}}{A_0}$$

In order to prevent the electrode element 7 from being twisted, it is sufficient to avoid such a process that an excess tension is applied to the electrode element 7 during the cooling process of the black treatment of the color selection electrodes shown in FIGS. 5A and 5B in which the AG 4 is welded to the frame 1 and the electrode element 7 is brought into a plasticity deformation region permitting the elongation and the twist. For this end, in this embodiment, experiments were made in which, by employing as a test piece the soft steel plate as the electrode element 7 having a thickness thereof set within the range from 0.1 mm for a small-size tube to 0.13 mm for a large-size tube and a width thereof set within the range from 0.5 mm to 0.8 mm, the tensile strength δB was measured at a maximum tension point of the color selection electrode shown in FIGS. 5A and 5B. In the above experiments, a value of $P_{max}$ was 60 kg.

When the tensile strengths δB of these test pieces were set to 90% of the tensile strength thereof obtained after the black treatment, the electrode elements 7 were twisted. When they were set to 85% or less, the electrode elements 7 were prevented from being twisted.

Further, when the tension of the electrode element 7 was set to 30% or less, even if the AG 4 was welded to the frame 1 with a predetermined tension to form the color selection electrode 10 for the color CRT and the respective electrode elements 7 were pressed by stretching two thin wires, each having a diameter of about 25 μm as vibration dampers with a proper tension perpendicularly thereto, the electrode elements 7 themselves which were loosely stretched were inevitably vibrated in accordance with a vibration externally applied, which extremely deteriorated an image.

Accordingly, in this embodiment, when the tensile strength δB of the electrode element 7 was selected within the range from 30% or greater to 85% or smaller, it was possible to obtain the color CRT which can suppress the deterioration of the resolution and reduce unevenness in color of an image.

According to the color CRT of the present invention, since the tension of the electrode element 7 at the portion where the tension of the electrode element 7 stretched across the frame 1 is a maximum is selected within the range of 85% to 30% of the tensile strength thereof, it is possible to prevent or reduce the twist of the electrode element 7 of the AG 4 of the color selection electrode 10. It is also possible to suppress the deterioration of the resolution of the color CRT and reduce the unevenness in the color of the image, which can extremely enhance the performance of the color CRT.

Having described a preferred embodiment of the present invention with reference to the accompanying drawings, it is to be understood that the present invention is not limited to the above-mentioned embodiment and that various changes and modifications can be effected therein by one skilled in the art without departing from the spirit or scope of the present invention as defined in the appended claims.

What is claimed is:

1. A color cathode-ray tube, comprising:

a frame including a plurality of frame members wherein at least one of said frame members is lateral-U-shaped, each of said lateral-U-shaped members further including end portions on each corresponding leg that are bent perpendicular to said legs, wherein at least one of said frame members is fixedly attached to said end portions; and an aperture grill including a plurality of electrode elements stretched across and fixedly attached to said frame such that a maximum tensile force within the range from 30% to 85% of tensile strength of said electrode elements is placed on each of said electrode elements.

2. The cathode ray tube as set forth in claim 1, wherein the frame comprises an upper frame member, a lower frame member, a left frame, member and a right frame member.

3. The cathode ray tube as set forth in claim 2, wherein the aperture grill is fixed to the upper frame member and the lower frame member.

4. The cathode ray tube as set forth in claim 3, wherein the aperture grill receives the tension which is directed from a center of the aperture grill toward the upper and lower frame members.

5. The cathode ray tube as set forth in claim 2, wherein the upper and lower frame members receive the compressive force which is directed toward each other.

6. The cathode ray tube as set forth in claim 1, wherein the frame has a different heat capacity as the aperture grill.

7. A method of manufacturing a color cathode-ray tube having a frame assembly therein, the steps comprising:

applying a compressive force to a frame comprised of an upper member, a lower member, a left member, and a right member in a direction in which said upper member and said lower member are brought closer to each other;

applying a predetermined tension to said aperture grill, which is a plate member and made as a color selection electrode having electrode elements arranged at an interval in a stripe fashion, in a longitudinal direction of said electrode elements;

stretching and fixing said aperture grill applied with said tension across and on said frame applied with said compressive force;

subjecting said frame and said aperture grill stretched and fixed thereto to heat treatment; and cooling said frame and said aperture grill after said heat treatment;

wherein said predetermined tension is set within a range from 30% to 85% of a tensile strength of said electrode elements of said aperture grill which have already been cooled.

8. The method of manufacturing the cathode ray tube as set forth in claim 7, wherein the step of stretching and fixing comprises a step of securing the aperture grill to the upper and lower member of the frame.

9. The method of manufacturing the cathode ray tube as set forth in claim 8, wherein the steps of securing comprises a step of welding the aperture grill to the upper and lower members of the frame.

10. The method of manufacturing the cathode ray tube as set forth in claim 7, wherein the step of subjecting the frame and aperture grill to heat treatment comprises the steps of placing the frame and aperture grill within a furnace, increasing a temperature of the furnace to a maximum temperature, and maintaining the temperature of the furnace at the maximum temperature.

11. The method of manufacturing the cathode ray tube as set forth in claim 7, wherein the step of cooling the frame and aperture grill comprises a step of reducing a temperature of a furnace.

* * * * *